US005922129A

United States Patent [19]

Kurtz et al.

[11] Patent Number: 5,922,129

[45] Date of Patent: Jul. 13, 1999

[54] MULTIPART DOCTOR BAR

[75] Inventors: Rüdiger Kurtz; Martin Kustermann, both of Heidenheim, Germany

[73] Assignee: Voith Sulzer Papiermaschinen GmbH, Heidenheim, Germany

[21] Appl. No.: 09/044,627

[22] Filed: Mar. 19, 1998

[30] Foreign Application Priority Data

Mar. 20, 1997 [DE] Germany ..... 197 11 728

[51] Int. Cl.[6] ..... B05C 1/00

[52] U.S. Cl. ..... 118/117; 118/118; 118/119; 118/123; 118/126; 118/261; 118/413; 118/419; 492/17; 492/24; 492/30; 492/38

[58] Field of Search ..... 118/117, 118, 118/119, 123, 126, 261, 413, 419; 427/359; 162/281; 15/256.5, 256.51, 256.52; 492/17, 18, 24, 30, 38, 40; 101/120

[56] References Cited

U.S. PATENT DOCUMENTS

| | | | |
|---|---|---|---|
| 776,796 | 12/1904 | Perkins | 492/40 |
| 1,901,818 | 3/1933 | Okerberg | 492/40 |
| 3,964,658 | 6/1976 | Edwards | 492/40 |
| 5,103,759 | 4/1992 | Henseler et al. | 118/118 |
| 5,454,868 | 10/1995 | Mendez | 118/216 |
| 5,481,895 | 1/1996 | Sendzimir et al. | 492/38 |

FOREIGN PATENT DOCUMENTS

| | | |
|---|---|---|
| 0453427 | 10/1991 | European Pat. Off. . |
| 0454643 | 10/1991 | European Pat. Off. . |
| 0674047 | 9/1995 | European Pat. Off. . |
| 43 40 578 C2 | 3/1995 | Germany . |
| 195 15 754 | 11/1996 | Germany . |

*Primary Examiner*—Laura Edwards
*Attorney, Agent, or Firm*—Taylor & Associates, P.C.

[57] ABSTRACT

In an apparatus for the application of a liquid or pasty substance onto a traveling material web, notably of paper or cardboard, a doctor bar serving the metering of the applied substance is composed of at least two bar segments strung together in the longitudinal direction of the doctor bar and fixedly joined to one another. Possible thereby, in the manufacture of the doctor bar, is an easier handling and a better compliance with accuracy requirements.

24 Claims, 3 Drawing Sheets

MULTIPART DOCTOR BAR

BACKGROUND OF THE INVENTION

1. Field of the Invention

The present invention relates to an apparatus for direct or indirect application of a liquid or pasty medium onto a traveling material web, notably of paper or cardboard, including at least one long doctor element for application and/or metering of the medium.

2. Description of the Related Art

Particularly in the paper industry, the tendency is noted to produce increasingly wider material webs. Their width frequently reaches several meters, for instance 6 to 8 meters, and occasionally up to 10 meters or more. A corresponding length is then required of the doctor bars or doctor slats used in a coating or sizing station of a paper or cardboard manufacturing system for applying a sizing solution or coating color onto the paper or cardboard webs and to meter the applied substance. A coating, for example of white or colored pigments, is applied onto the paper or cardboard webs in such a coating station so as to close pores that are still present in the material and to cover and level out the surface of the material. Obtained thereby can be continuous and smooth surfaces on the paper or cardboard, such as needed for a demanding and sharp image reproduction, for example, in copiers or in printing plants.

Doctor elements are used in the direct and indirect application of coating substance. In indirect application, the substance is first applied onto an applicator roll, from which it transfers onto the material web. In direct application, the substance is applied directly onto the material web. The doctor elements serve in both cases to even out the applied substance, to safeguard its exact metering, and to strip, i.e., doctor down, the substance surpluses. Doctor bars are usually mounted rotatably in a doctor bed and rotated by use of a rotary drive arrangement. Also employed for these purposes, however, are stationary doctor elements, for example, doctor slats or doctor blades.

Doctor elements are generally made of steel. They frequently have a hard chrome plating on their surface or feature an outside layer of ceramic or fiber material, for example, glass fiber, carbon fiber, or fiber-reinforced material. Their surface may be smooth or rough or, for volumetric application, provided with a surface profiling, e.g., a grooving pattern. Also known are wire-wound round-section rods, so-called wire doctors.

Doctor elements are customarily fabricated in a single piece across their entire length. Relevant patent documents are German Patent Document No. DE 195 15 754 C1 and European Patent Document Nos. EP 0 453 427 A2, EP 0 454 643 B1 and EP 0 674 047 A2. Stringent requirements are likewise imposed on the manufacturing accuracy of the doctor elements. Difficulties particularly arise with large lengths of the doctor elements, such as lengths of several meters as needed for modern paper and cardboard manufacturing systems. To begin with, the doctor elements are very slender, frequently having diameters, in the case of doctor bars, of as little as 9 to 20 millimeters, but maximally 80 to 200 millimeters. The doctor elements must be handled very carefully both in their manufacture and in shipping or installation in order to avoid damage to the doctor surface, bending and other damage. Even the slightest bending, such as might occur, e.g., in the shipping of very long, single-piece doctor elements, is not acceptable in view of the high accuracy requirements. Moreover, the machines used in the manufacture of the doctor elements must be adapted to the large length of the doctor elements. For example, sagging of the bars, slats or tubes serving as initial material, such as may occur very easily with the large lengths concerned, must be prevented from resulting in finishing inaccuracies. In any case, it is difficult to provide bars or tubes of the required lengths which possess sufficient straightness. Lastly, the different customer needs make it necessary to manufacture the doctor elements individually in the desired length or design.

SUMMARY OF THE INVENTION

The present invention simplifies the manufacture, storage and shipping of the doctor elements while nonetheless meeting the accuracy demands. The doctor element of the present invention includes at least two segments which in the length direction of the doctor element are fixedly joined to one another.

At first glance, a multipart doctor element, e.g., a doctor bar, seems to involve an increased manufacturing expense since the individual bar segments must be joined to one another to form the finished doctor bar. This apparent disadvantage, however, is more than compensated for by the advantages deriving from the multipart design of the doctor bar. In comparison, the handling of short bar segments is considerably simpler and reduces the risk of damage. This is true both for the machining of the initial material and also for the subsequent storage and shipping to the customer. Besides, the manufacturer of the doctor bars enjoys much greater flexibility regarding the availability of different doctor bars, since they can be assembled as needed from prefabricated bar segments in the desired length or desired design. This eliminates the necessity of manufacturing suitable doctor bars separately for individual customers. Adopted, instead, may be the mass production of short bar segments which can serve as standard bar segments for doctor bars of selective lengths. The present invention makes possible a modular system with several basic bar segments which can be assembled selectively to produce most varying doctor bars.

Moreover, the bar segments facilitate meeting the required accuracy tolerances in the manufacture of the doctor bars, since short bar sections allow a considerably easier and thus more precise finishing than do bars that are several meters long. This is particularly true when the bar segments are provided with a surface profiling. Lastly, the doctor bars which are assembled of several bar segments display a greater stability against bending, and thus a more exact straightness, thereby improving the operating accuracy of the applicator and avoiding uneven wear and wear phenomena of the doctor bars.

It is possible that at least part of the segments of the doctor elements are joined to one another detachably. This allows replacement of individual worn segments or, when needed, adaptation of the doctor element to a different type of applicator by addition or removal of individual segments.

The segments of the doctor elements may also be clamped together with the aid of clamping devices extending at least across a large part of the doctor element length. The clamping device may include a clamping organ formed separately from the doctor element segments and extending at least across a major part of the doctor element length. Possible e.g., is a tie-rod which extends through a tubular doctor bar and bears on its ends.

The segments of the doctor bar may be joined in pairs; possible joining techniques are gluing, welding or brazing. As an alternative, or in addition, two segments may possess on their facing joining ends complementary coupling devices serving the nonpositive and/or form-fit and/or friction-fit coupling of the two segments. For example, the two segments may be screwed to each other. Also possible is a nesting joint between two segments, e.g., in the form of a taper joint. Moreover, the coupling device may include a jaw coupling. Lastly, it is also possible to join the facing ends of two segments by shrink-fit, in which case an additional welding or gluing of the joint may be given consideration. The latter may be required, specifically, when the coupling devices merely provide for a positive engagement of the joining ends of two segments without simultaneous nonpositive or friction fit. Such may be the case, e.g., with a tenon-and-mortise joint merely serving the exact positioning of the two segments.

The idea of a modular construction of the doctor element is particularly supported by the measure that at least some of the segments of the doctor element be identical in length, preferably also identical in design. The desired length of a doctor element can then be obtained by joining an appropriate number of identical segments and adding a specially fabricated remainder segment with a required residual length for individual adaptation.

Irrespective of the type of doctor elements, be they smooth, rough, grooved, wire-wound or provided with a specific outer layer, the mounting of the doctor elements on their ends will frequently be the same. One may then fabricate, within the scope of the invention, uniform, smooth end segments which can be used for such selective doctor types. Therefore, it is proposed that the doctor element include on at least one of its ends an end segment which in the longitudinal direction of the doctor element is disposed completely, or at least substantially completely outside a doctor surface of the doctor element.

The advantages of the invention can be particularly utilized whenever the length of a segment amounts to no more than one-half, perhaps no more than one-fifth, and possibly no more than one-tenth of the overall length of the doctor element. In absolute dimensions, the length of a segment can amount to no more than 5 meters, perhaps no more than 3 meters, and possibly no more than 1 meter.

The inventional configuration of the doctor elements can be used both with doctor bars of approximately circular cross section and with doctor slats or doctor blades with a noncircular cross-sectional shape. Either solid material profiles or hollow profiles may be used to form the doctor elements.

Protection is also provided for a paper or cardboard manufacturing system including at least one applicator of the type described above.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
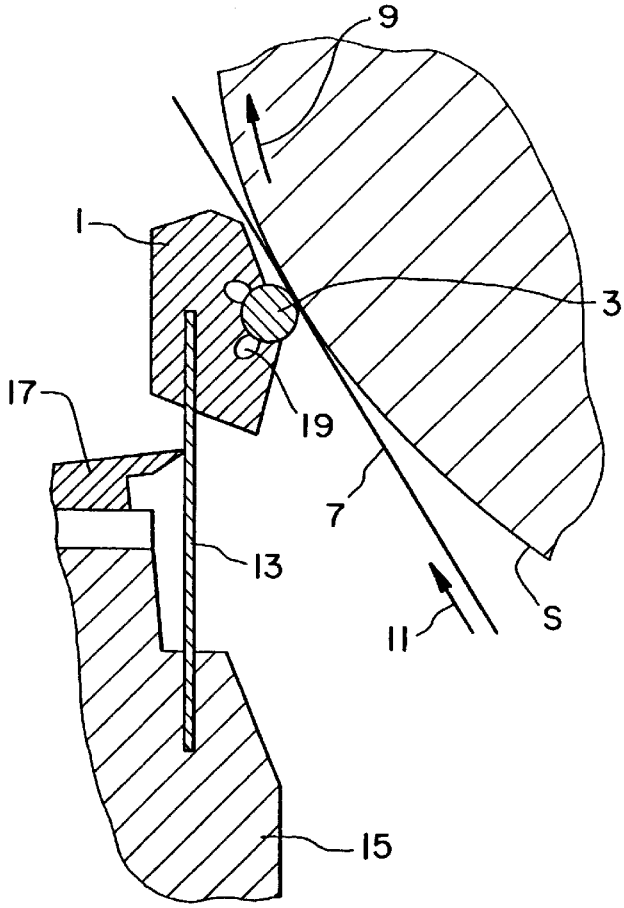
FIG. 1 is a schematic, side, sectional view of one embodiment of a doctor element of the present invention, in the form of a doctor bar, in an inventional applicator.

FIG. 1 depicts a doctor bar 3 mounted in a doctor bed 1 so as to rotate about its longitudinal axis and set against a backing roll 5. A substrate web 7 to be coated, e.g., a paper or cardboard web, runs between the doctor bar 3 and the backing roll 5. Backing roll 5 is powered in the direction of rotation marked by arrow 9, so that substrate web 7 is in the direction of travel, as indicated by arrow 11, pulled through between doctor bar 3 and backing roll 5. Doctor bed 1 is held by a spring arrangement 13 including e.g., a leaf spring, on a support base 15. An elastic loading of doctor bar 3 against backing roll 5 can be adjusted by an actuator 17 acting on spring arrangement 13. Rinsing water ducts 19 allow cleaning of doctor bed 1 of doctor bar 3, removing stripped coating substance.

In the illustrated embodiment, doctor bar 3 acts as a so-called roll scraper, substrate web 7 being carried on backing roll 5. Naturally, doctor bar 3 may also be employed as a so-called roll doctor, where substrate web 7 is carried directly on doctor bar 3. Backing roll 5 is then dispensable. Supported across its entire length by doctor bed 1, doctor bar 3 is powered mostly on both ends by way of a rotary drive system. The coating substance stripped by doctor bar 3 is usually collected, reconditioned and recycled via a working container back to an applicator container.

Figure 2:
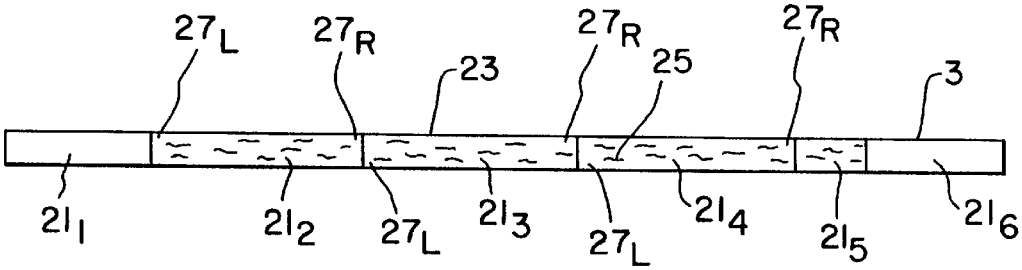
FIG. 2 is a front view of the doctor bar of FIG. 1 including several bar segments.

FIG. 2 shows a doctor bar 3 composed of several bar segments $\mathbf{21}_1$–$\mathbf{21}_6$. Bar segments $\mathbf{21}_1$–$\mathbf{21}_6$ are strung in the length direction of doctor bar 3 and fixedly joined to one another in pairs. Doctor bar 3 has a doctor surface 23 whose width matches in the length direction of doctor bar 3 the width of the substrate web 7 to be coated or is somewhat larger. Doctor surface 23 is provided with unevenness 25 indicated schematically. These may be a roughing, a spiral grooving pattern or a wire wrap. The length of doctor bar 3 may be up to about 12 meters, its diameter may be between 9 and 200 millimeters and the depth of the unevenness, that is, the surface roughness, may be between 0.1 and 5.0 $\mu$m. Doctor bar 3 may either be solid in cross section, i.e., formed of solid material, or may be formed of tubing with a circular cross section.

From FIG. 2 it is apparent that doctor surface 23 merely extends across bar segments $\mathbf{21}_2$–$\mathbf{21}_5$, whereas the endwise bar segments $\mathbf{21}_1$ and $\mathbf{21}_6$ are smooth and do not have a profile. These end sections $\mathbf{21}_1$ and $\mathbf{21}_6$ serve the mounting and the rotary powering of doctor bar 3 and may be of a uniform design for any type of doctor bar. Bar segments $\mathbf{21}_2$, $\mathbf{21}_3$ and $\mathbf{21}_4$ are equal in length and can also be of identical design as regards their interfacing with the relevant adjacent bar segments. As far as specific coupling devices provided for joining the individual bar segments, bar segments $\mathbf{21}_2$ through $21_4$ may each feature, e.g., on their left joining end $27_L$ in FIG. 2, a female coupling device, and on their right-hand joining end $27_R$ a complementary male coupling device. This allows the mass production of standard bar segments which can be utilized as uniform basic modules for doctor bars of different length. Comparatively short, bar segment $21_5$ serves the individual adaptation to a desired overall length of doctor bar 3 when the overall length cannot be established with existing standard bar segments.

Figure 3:
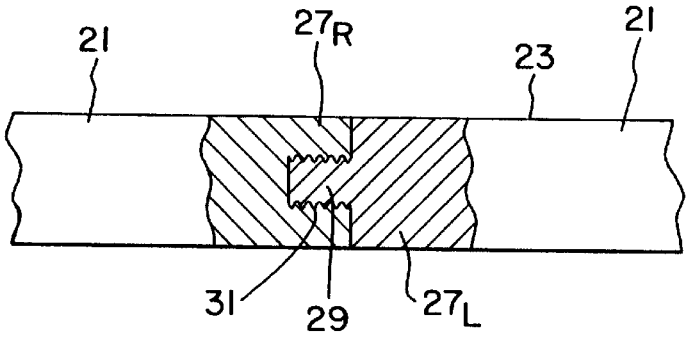
FIG. 3 is a front view of a screw joint of two of the bar segments of FIG. 2.

FIG. 3 shows a screw joint of two bar segments 21 of solid material with a smooth doctor surface 23. Formed on the left joining end $27_L$ of the right-hand bar segment 21 in FIG. 3 is a centered threaded arbor 29 screwed in a coordinated tapped blind hole 31 in the right-hand joining end $27_R$ of the left bar segment 21 in FIG. 3.

Figure 4:
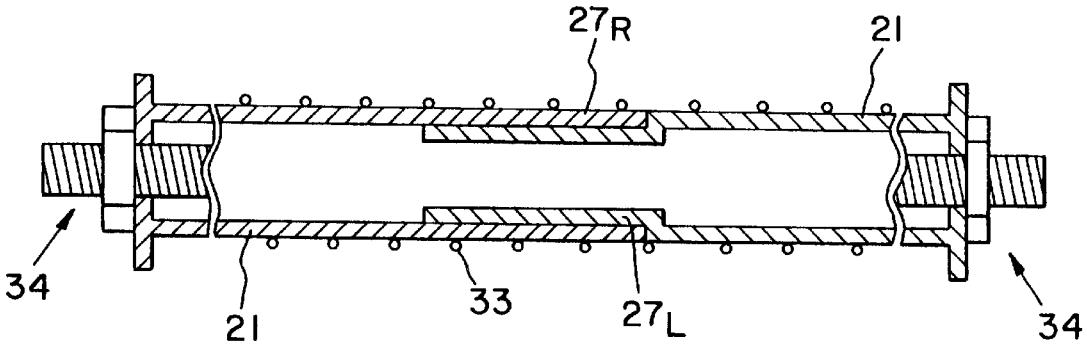
FIG. 4 is a front view of a shrink-fit joint of two of the bar segments of FIG. 2.

FIG. 4 illustrates a shrink-fit joint of two bar segments 21 formed of a tubular profile. The right-hand bar segment 21 in FIG. 4 features a left joining end $27_L$ of reduced diameter, the end being inserted in the right-hand joining end $27_R$ of the left bar segment in FIG. 4. The diameters of the joining end $27_R$ of the left bar segment 21 and of the joining end $27_L$ of the right-hand bar segment 21 are fabricated to press fit dimensions. Prior to joining the two bar segments 21, the joining end $27_R$ of the left bar segment 21 is heated for expansion. The joining end $27_L$ of the right-hand bar segment 21 then slips relatively easily into the joining end $27_R$ of the left bar segment 21. As the left bar segment 21 then cools down, the joining end $27_R$ of the bar element 21 shrinks and establishes the nonpositive and frictional press fit on the joining end $27_L$ of the right-hand bar segment 21. Smooth on their surfaces, bar segments 21 are in this embodiment wound with a wire wrap 33.

It is also possible for segments 21 to be clamped together with the aid of a clamping device 34 extending at least across a large part, or a majority, of the length of the doctor element. Clamping device 34 is shown in the form of a clamping organ including a hollow tie rod which extends through the tubular doctor element and bears on its ends.

Figure 5:
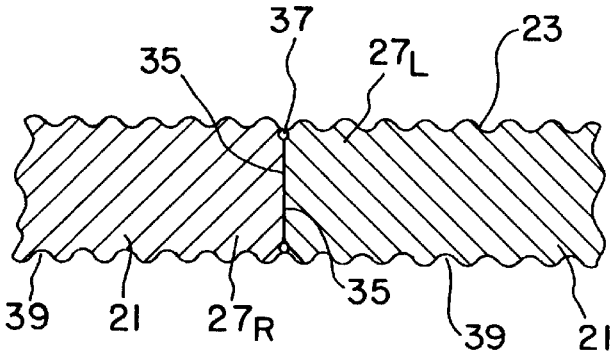
FIG. 5 is a front view of a welding joint of two of the bar segments of FIG. 2.

FIG. 5, lastly, shows two bar segments 21 of solid material butted with their longitudinally orthogonal butting faces 35 and welded to one another in the butt area. Circumscribing the periphery of bar segments 21, a weld 37 illustrates the welding joint. The doctor surface 23 in this embodiment is formed of a grooving profile 39 machined helically in bar segments 21.

Figure 6:
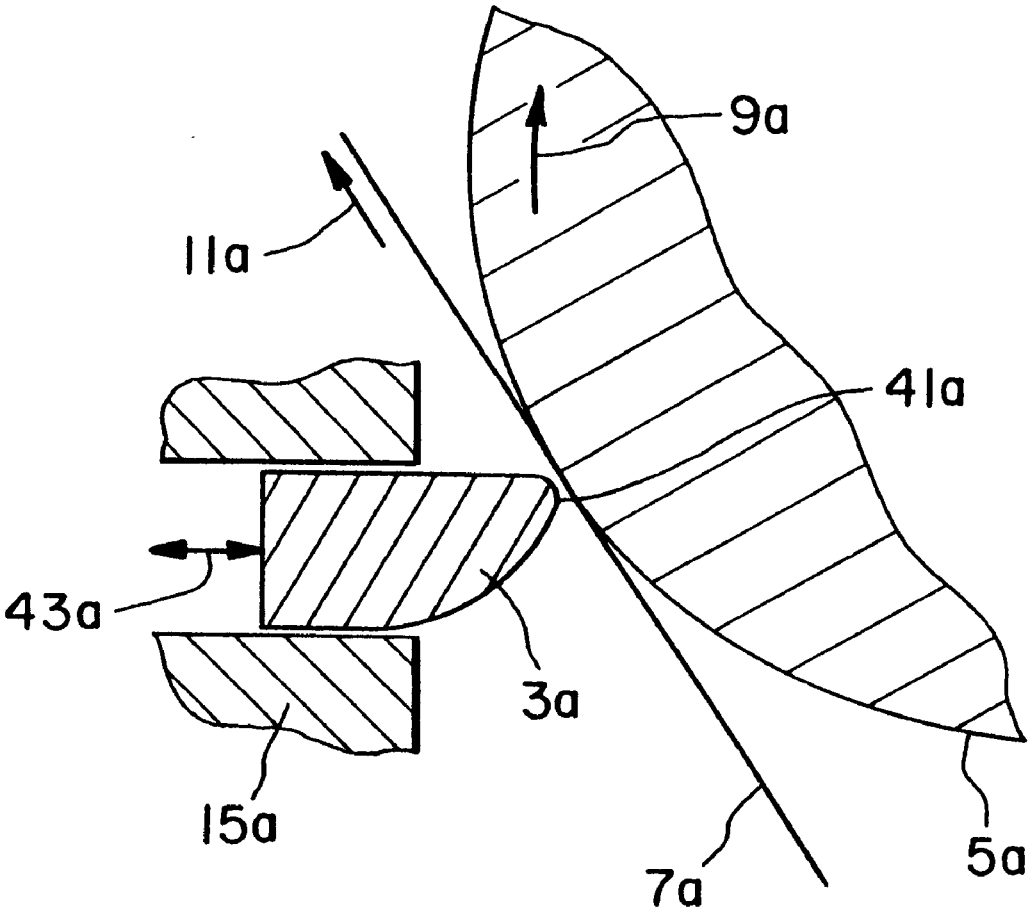
FIG. 6 is a schematic, side, sectional view of another embodiment of a doctor element of the present invention, in the form of a "stationary" doctor slat, in an inventional applicator.

In the embodiment shown in FIG. 6, as far as identical or identically acting components are concerned, references identical with those in the preceding figures are used, but with the lowercase a suffixed. Unless something different derives from the following, reference is made, for the description of the components, to the above explanations given for FIGS. 1 through 5.

The variant of FIG. 6 differs from the embodiment relative to FIG. 1 in that doctor element 3*a* is formed by a "stationary", that is, nonrotatably mounted doctor slat. The doctor slat, with a metering edge 41*a*, is set against the substrate web 7*a* to be coated, optionally directly against backing roll 5*a*. Metering edge 41*a* may be designed as a pointed edge; however, as readily seen in FIG. 6, it may also be rounded to a small radius. Not illustrated in detail, an actuator allows adjustment of the doctor slat 3*a* retained in support base 15*a*, in the directions of double arrow 43*a*, so that the distance of doctor slat 3*a* from substrate web 7*a* or backing roll 5*a* may be set as required. The illustrated cross-sectional shape of the doctor slat is for example only. It may vary up to a distinctly flat cross section, for example with blade type doctors. The inventional idea of the multi-part design of doctor slat 3*a* may also be readily utilized in such cases.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for application of a coating medium onto a traveling fiber material web, said apparatus comprising at least one doctor element having a substantially solid and continuous cross section and a length with a direction, said at least one doctor element being configured for at least one of application and metering of the coating medium, said at least one doctor element including at least two segments oriented in said direction of said length of said at least one doctor element, each said segment having at least one facing joining end extending continuously through said cross section of said at least one doctor element, said segments being detachably joined to one another at respective said facing joining ends to thereby allow modification of said length of said at least one doctor element.

2. The apparatus of claim 1, wherein at least two of said segments are detachably joined to one another.

3. The apparatus of claim 2, wherein said apparatus further comprises clamping means for clamping said segments of said at least one doctor element onto one another, said clamping means extending at least across a majority of said length of said at least one doctor element.

4. The apparatus of claim 3, wherein said clamping means comprises a clamping organ.

5. The apparatus of claim 1, wherein said segments of said at least one doctor element are joined to one another in pairs.

6. The apparatus of claim 5, wherein each said pair of joined segments includes two facing joining ends, said facing joining ends being one of glued, welded and brazed to one another.

7. The apparatus of claim 5, wherein each said pair of joined segments includes two facing joining ends, said two facing joining ends having mutually complementary coupling means for coupling said pair of joined segments, said coupling being at least one of nonpositive, form-fit and friction-fit.

8. The apparatus of claim 1, wherein each of at least two of said segments of said at least one doctor element have corresponding substantially equal lengths.

9. The apparatus of claim 8, wherein at least two of said segments of said at least one doctor element are substantially identical.

10. The apparatus of claim 1, wherein each of said segments is not greater than one-half of said length of said at least one doctor element.

11. The apparatus of claim 10, wherein each of said segments is not greater than one-fifth of said length of said at least one doctor element.

12. The apparatus of claim 11, wherein each of said segments is not greater than one-tenth of said length of said at least one doctor element.

13. The apparatus of claim 1, wherein each of said segments is not greater than 5 meters.

14. The apparatus of claim 13 wherein each of said segments is not greater than 3 meters.

15. The apparatus of claim 14, wherein each of said segments is not greater than 1 meter.

16. The apparatus of claim 1, wherein said at least one doctor element includes a doctor surface, two opposite ends, and two end segments, at least one of said end segments being on a corresponding said opposite end of said doctor element and being disposed substantially outside of said doctor surface.

17. The apparatus of claim 1, wherein each said at least one doctor element comprises a doctor bar having a substantially circular cross section.

18. An apparatus for application of a coating medium onto a traveling fiber material web, said apparatus comprising at least one doctor slat having a substantially noncircular cross section and a length with a direction, said at least one doctor slat being configured for at least one of application and metering of the coating medium, said at least one doctor slat including at least two segments oriented in said direction of said length of said at least one doctor slat, said segments being joined to one another.

19. The apparatus of claim 1, wherein each said at least one doctor element includes a smooth outside surface.

20. The apparatus of claim 1, wherein each said at least one doctor element includes a textured outside surface.

21. The apparatus of claim 20, wherein said textured surface comprises a grooved surface.

22. A manufacturing system for one of paper and cardboard, said manufacturing system comprising an apparatus for application of a coating medium onto a traveling fiber material web, said apparatus including at least one doctor element having a substantially solid and continuous cross section and a length with a direction, said at least one doctor element being configured for at least one of application and metering of the coating medium, said at least one doctor element including at least two segments oriented in said direction of said length of said at least one doctor element, each said segment having at least one facing joining end extending continuously through said cross section of said at least one doctor element, said segments being joined to one another.

23. The apparatus of claim 1, wherein said at least one doctor element is non-rotatably mounted and has a substantially noncircular cross section.

24. The apparatus of claim 1, wherein said at least one doctor element is substantially stationary.

* * * * *